United States Patent [19]

Maccaferri et al.

[11] Patent Number: 4,760,669

[45] Date of Patent: Aug. 2, 1988

[54] MACHINE FOR GRINDING THE BRAKE DISCS OF MOTOR-VEHICLES

[76] Inventors: Galeazzo Maccaferri, 5, Via G.F. Barbieri; Giuseppe Giberti, 75, Via Cremona, both of Pieve di Cento (Bologna), Italy

[21] Appl. No.: 862,489

[22] Filed: May 12, 1986

[30] Foreign Application Priority Data

May 14, 1985 [IT] Italy ..... 12492 A/85

[51] Int. Cl.[4] ..... B24B 7/17

[52] U.S. Cl. ..... 51/117; 51/241 S; 51/251; 51/132

[58] Field of Search ..... 51/117, 241 R, 241 S, 51/241 B, 241 VS, 251, 118, 132

[56] References Cited

U.S. PATENT DOCUMENTS 3,456,401 7/1969 Kushmuk ..... 51/251
3,590,537 7/1971 Hennig ..... 51/241 S
4,361,988 12/1982 Gramlich ..... 51/241 S

*Primary Examiner*—Frederick R. Schmidt
*Assistant Examiner*—Robert A. Rose
*Attorney, Agent, or Firm*—Larson and Taylor

[57] ABSTRACT

The machine comprises a frame (1) which is secured to the connections (A—A') to which the hydraulic caliper for the brake is usually secured, the caliper having been removed previously. Due to such a connection, the frame (1) will be positioned exactly and firmly with respect to the brake disc, so that by mounting on the frame a grinding equipment comprising the axial feed for the grinding wheel or wheels (15—15'), the disc (D) may be ground without disassembling it. The brake disc is caused to rotate by the grinding wheel working thereon and, optionally, by a small motor-reducer, the arrangement being such as to perform a uniform grinding of the entire surface of the disc. The spindle of the machine, preferably, carries two grinding wheels which, successively, will engage both faces of the brake disc.

4 Claims, 3 Drawing Sheets

MACHINE FOR GRINDING THE BRAKE DISCS OF MOTOR-VEHICLES

SUMMARY OF THE INVENTION

At present, or order to grind the brake discs of motor-cars and motor-vehicles in general, said discs must be disassembled from their supports to be then ground by means of a conventional grinding machine. This procedure implies disadvantages that may be summarized as follows. Firstly, it is time-consuming and expensive, due to the requirements of disassembling the brake discs, of effecting - most of time - the grinding operation at highly-skilled workshops, and finally of re-assembling said discs on their supports. Sometimes, a brake disc might not be centered exactly during the grinding operation, with resulting undesired and even dangerous vibrations when using the brakes.

The invention provides a machine which may be manufactured easily and at low cost, which permits both faces of a brake disc to be ground without requiring it to be removed from its supports, and, therefore, which permits the grinding to be effected with a rapidity and precision otherwise unattainable. The machine of the invention, moreover, can be operated easily and, therefore, it may be used with reliability and precision even by persons who are not highly skilled.

BRIEF DESCRIPTION OF THE DRAWINGS

These and other advantages of the machine of the invention and the constructional characteristics thereof will be apparent from the following description of a preferred embodiment thereof, shown in the Figures of the three accompanying sheets of drawings, wherein.

DESCRIPTION OF THE PREFERRED EMBODIMENT

The conception of the machine of the invention takes origin from the following considerations. After removing a wheel of a motor-vehicle, the brake disc would be accessible only on its outer face for a grinding operation, because its inner face is usually protected by a casing which is fixed to the structure carrying the axle journal which rotatably supports said brake disc. In order to effect the grinding of also the other face of the brake disc, a simple and rapid operation may be carried out: the removal of the hydraulic caliper carrying the pads acting on said disc during the braking action. Said operation requires the removal of only two screws. The space made available by the removal of said caliper would permit also the machining of the face of the brake disc directed inwards of the frame of the vehicle. Now, it has been conceived that it was possible to use the two mounting connections for said caliper, and connect thereat auxiliary structure that, when secured thereto, would comprise at least a portion having a pre-established and exact positioning with respect to the faces of the brake disc. By mounting on said portion a small grinding station with its motion devices, it would be possible to operate by means of a grinding means, successively, both faces of said disc to achieve a precision grinding thereof. In practicing this solution, it has been remarked that, in most motor-vehicles and in many other cases, it is not necessary to provide means for forcedly rotating the brake disc because this rotation can be induced by, and resulting from, the frictional co-operation of said disc with the grinding wheel.

Figure 1:
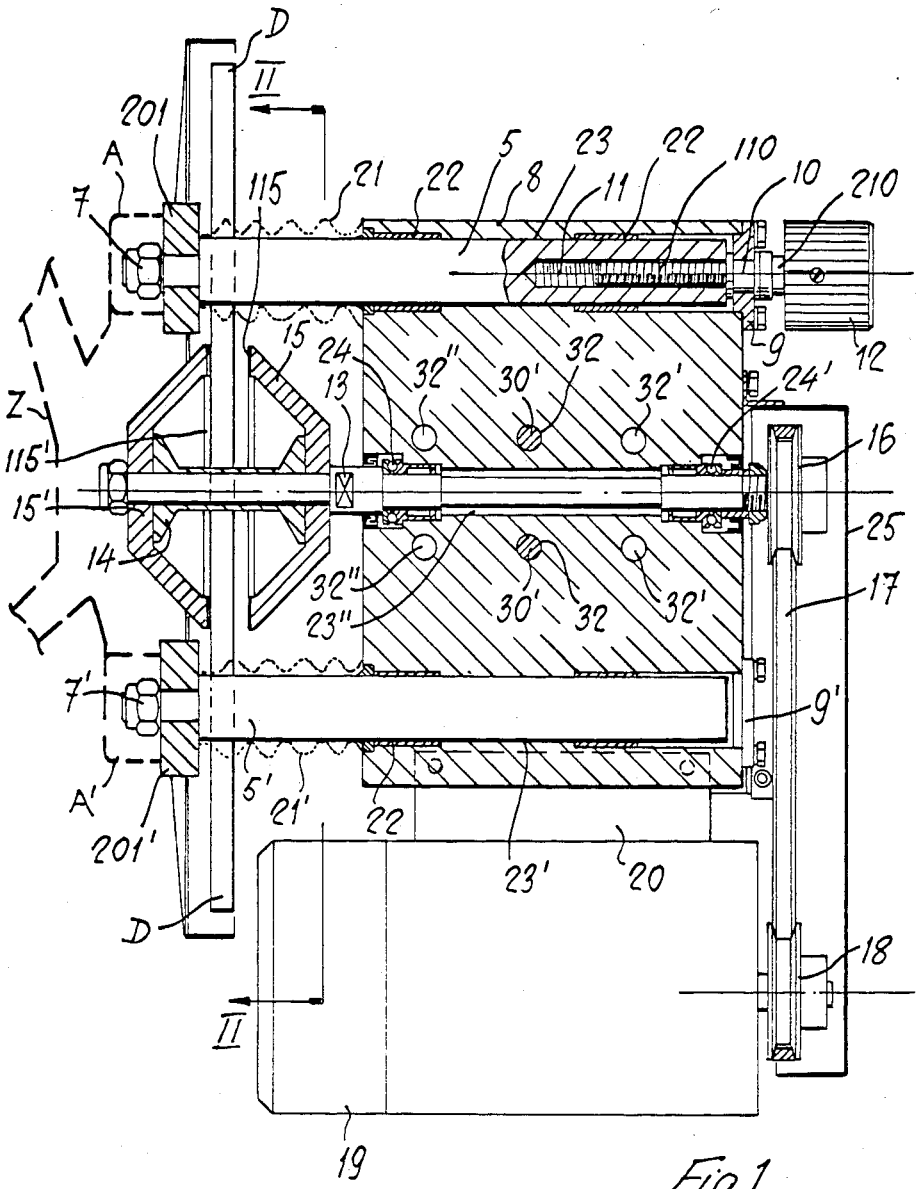
FIG. 1 is a side elevational and partly sectional view of the machine during the grinding of a brake disc.
Figure 2:
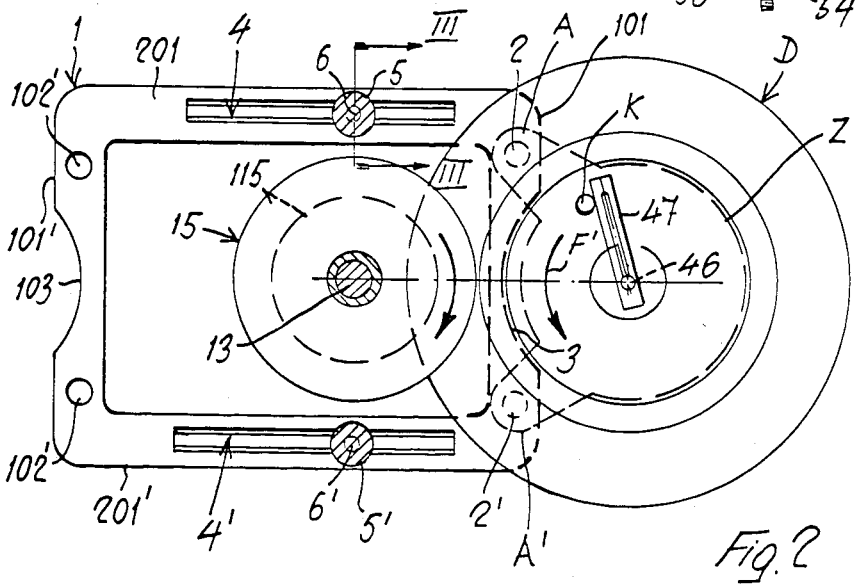
FIG. 2 shows some parts of a machine, as seen from the section line II—II of FIG. 1.
Figure 3:
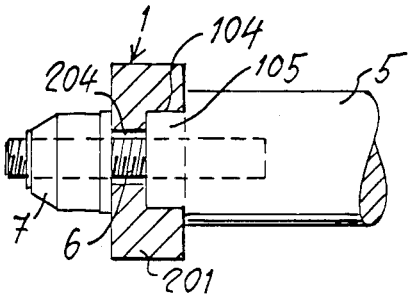
FIG. 3 shows a constructional detail of the machine, as seen from the section line III—III of FIG. 2.

With reference first to FIGS. 1, 2 and 3, the numeral 1 indicates a flat-shaped frame, for example of rectangular configuration, with rounded corners and provided on at least one of the shorter sides 101 (see below) with two threaded holes 2–2' by means of which said frame 1 can be secured to the connections A–A' of the axle journal support Z, said connections being usually used for the hydraulic braking caliper which has been removed previously. The frame 1 is secured to A–A' by means of screws (not shown) passed through the holes of the connections A–A' and screwed into said holes 2–2'. The side 101 of the frame 1 is, moreover, characterized in that it comprises a recess also permitting the side 101 to be suitably spaced from the adjacent active portion of the rear face of said brake disc D rotatably mounted on said support Z. The frame 1 is also characterized in that it comprises two longitudinal longer sides 201–201' formed with two rectilinear slots 4–4', parallel to each other and (as shown in the detail of FIG. 3) having a portion 104 directed outwards with respect to the vehicle and wider than the other portion 204 (FIG. 3). For the purpose of the invention, the frame 1 is to be machined with precision at least at the areas around the holes 2–2', intended to be engaged with the connections A–A', and around the slots 4–4', whereby after securing said frame 1, the slots 4–4' will have a preestablished and exact positioning with respect to both faces of the disc D to be ground.

The wider portion 104 of the slots 4–4' receives with a precision-fit the flattened end portion 105–105', respectively, of a pair of parallel round-section rods 5–5' provided at said flattened ends with threaded studs 6–6' which are passed through the other portion 204 of said slots to protrude from the rear side of the supporting frame 1 so that by means of nuts 7–7' said rods 5–5' can be fixed to said frame and due to such a connection and co-operation with the slots 4–4' they will be positioned perpendicularly to the imaginary planes containing the two faces of the disc D. The rods 5–5' are mounted—so as to be axially slidable with precision, by means of bushes 22 or other suitable means - within parallel through-holes 23–23' formed in the upper and lower portions, respectively, of a plate or slide 8 made of aluminium or any other material of low specific gravity and provided centrally with a third through-bore 23'' which is parallel and co-planar with said bores 23–23'. The ends of the bores 23–23' facing towards the operator are closed by respective covers 9—9'. The upper cover 9 has perpendicularly and rotatably mounted thereon, through means preventing its axial displacements, the intermediate portion of a screw 10 that by means of a threaded portion 110 co-operates with a threaded hole 11 formed axially in the rod 5 and that by means of the opposite portion 210 protrudes from said cover to receive a control knob 12. By rotating said knob, the slide 8 may be slidably moved along the guide rods 5–5'. Preferably, the portions 110-11 have a relatively fine-pitch thread whereby the displacement of the slide 8 along the rods 5–5' may be effected slowly and with no effort by the operator. According to a modification (not shown) a similar system of threaded screw with cooperating nut screw may be provided for the rod 5' and the two screws are interconnected by means of toothed pulleys and a toothed belt, the whole so as to render more easy and safe the movement of the slide 8 along said rod 5, 5'. Rotatably mounted through bearings 24–24' in the central through-bore 23" of the slide 8, is the intermediate portion of a shaft 13 which is parallel to said rods 5–5' and which is adapted to support axially, at the end directed towards the frame 1, with an interposed spacer 14, a pair of cup-shaped diamond grinding wheels 15–15' having the same characteristics and the active surfaces of which 115–115' are parallel to each other and to the faces to be ground of the disc D and are spaced apart to an extent greater than the maximum thickness of the brake discs presently used on the vehicles of the various manufacturers. The grinding wheels 15–15' have such a diameter as to operate, by a sector of their abrading surface, over the entire transverse surface of the active portion of the faces of the disc D (see FIG. 2). Keyed on the other end of the shaft 13 is a pulley 16 which, through a belt 17, is operatively connected to another pulley 18 which is keyed on the shaft of an electrical motor 19 which is secured by means of suitable brackets 20 to the lower portion of the slide 8. The belt-and-pulley drive 16-17-18 and the motor 19 have such characteristics whereby the grinding wheels 15–15' will be driven at the required operative speed.

The numeral 25 indicates a protective casing for the members 16-17-18, and of the outer side of said casing there may be mounted, advantageously, the electrical controls and connections (not shown) for operating the machine.

The machine of the invention operates as follows: for practical reasons, the operator may first secure the frame 1 to the connection A—A and may then secure the guide rods 5–5' to the frame 1, taking care that the projections of the grinding wheels 15–15' onto the active areas over the entire transverse extent thereof, as shown in FIG. 2. By activating the electrical motor 19, the grinding wheels 15–15' start rotating, for example, in the direction indicated by the arrow F in FIG. 2. By acting on the knob 12 (FIG. 1), the grinding wheels may be moved, one by one, to operatingly interfere with one and thereafter with the other of the two faces of the disc D which, due to the frictional engagement with said grinding wheel, starts rotating at once about its axis, as indicated by the arrow F' in FIG. 2. As a result of this induced rotation, the disc D will be ground uniformly over the entire extent of the face that is being acted upon the the respective grinding wheel 15 or 15'. On completion of the grinding operation, the disc D stops rotating and makes the operator aware of this condition. It is apparent that the disc D can be ground with rapidity and precision by the machine of the invention. On the completion of the operation, the frame 1 is removed from the connections A–A' and the hydraulic braking caliper is attached again thereto.

In order to mount the frame 1 on the right-hand and on the left-hand connections of any vehicle, said frame 1 needs only to be rotated by 180° so that the wider portions 104 of said slots 4–4' will be facing outwards at all times.

A frame 1 will be supplied to suit each type of vehicle. However, as shown in FIG. 2, the shorter side 101' of each frame 1 may also be provided with threaded holes 102–102' and a recess 103 of such dimensions as to increase the possibilities of utilization of one frame 1. Two small bellows 21–21', as shown with dotted lines in FIG. 1, may be used to protect the portions of the rods 5–5' that would be otherwise struck by the grit resulting from the grinding of the disc D.

Figure 5:
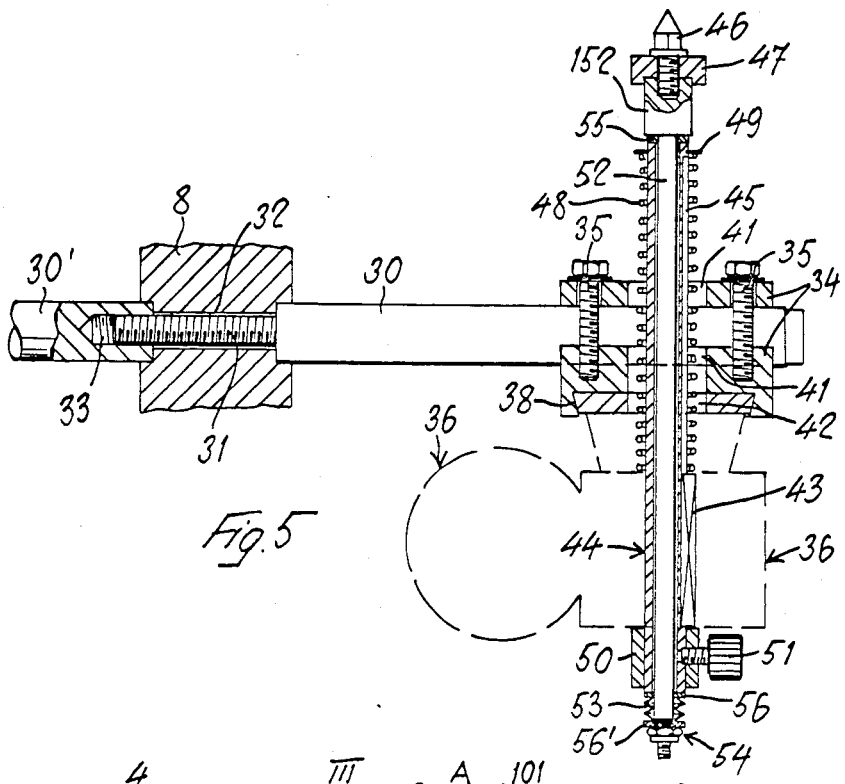
FIG. 5 shows some details of the machine of FIG. 4, as seen from the section line V—V.
Figure 4:
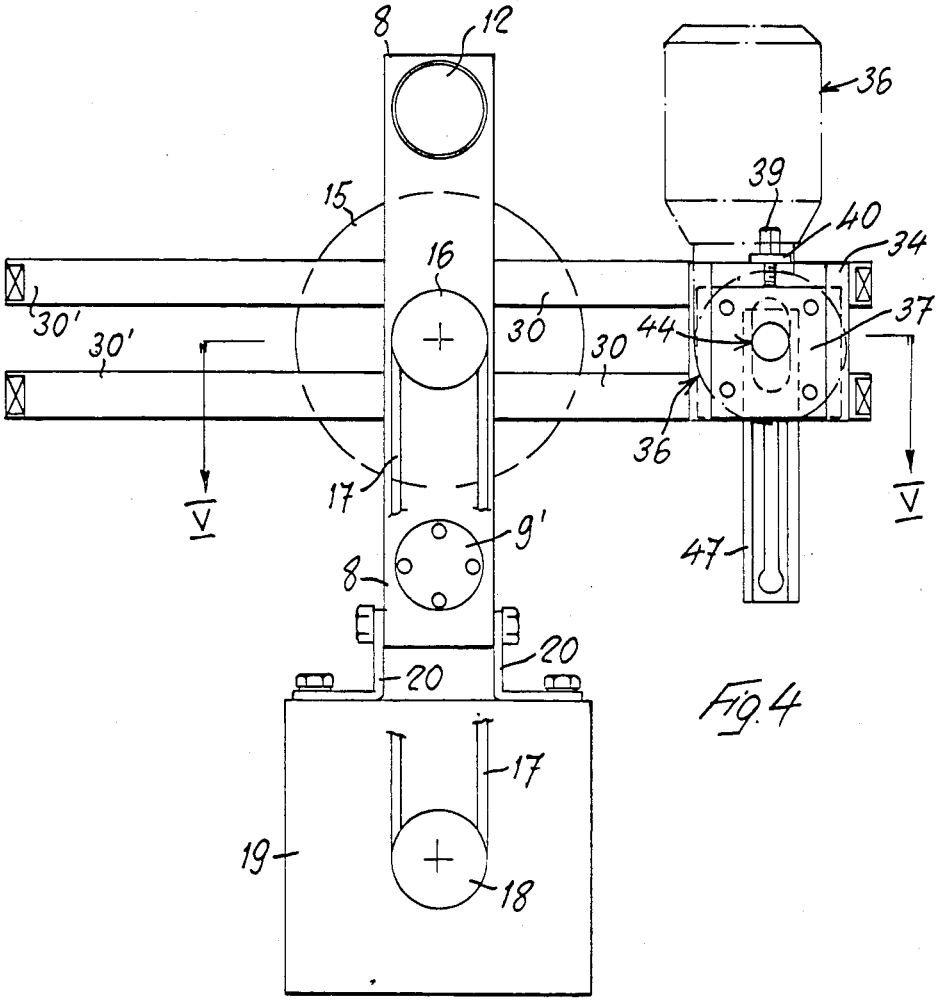
FIG. 4 is a front elevational view of the machine as viewed by the operator, and provided with a motor-reducer causing the forced rotation of the disc to be ground.

When operating on the brake discs on the drive axles of a motor-vehicle, i.e. those connected to the engine, it may happen that - due to the considerable friction losses in the drive transmission to said axles - the grinding wheel 15–15' cannot cause the rotation of the disc D. In this instance, the machine of the invention is adapted for easily and quickly mounting thereon a small auxiliary motor-reducer which, by a driving dog, causes the required rotation of the disc D so that the entire surface thereof to be ground may cooperate with the active surface of the grinding wheels 15–15'. More particularly, it will be seen in FIG. 4 and 5 that, perpendicularly fixed in cantilever fashion each side of the slide 8, there is a pair of guides 30 which are co-planarly in line on an imaginary vertical plane. As shown in the detail view of FIG. 5, the guides 30 are formed by round-section rods, and the rods located at one side of the slide 8 are provided at one end thereof with screws 31 which are passed through stepped holes 32 in the slide 8 and are screwed into threaded holes 33 of the guides 30' located at the opposite side of said slide 8. It will be seen in FIG. 1 that the slide 8 is formed with a plurality of pairs of holes 32–32'–32" to permit the guides 30 to suit various operative requirements. Mounted on the guides 30 is a small clamp-like slide 34 which may be locked on said guides by means of screws 35. On the side of the slide 34 that is directed toward the operator, there is mounted a small motor-reducer 36 whose axially hollow slow-moving shaft must be axially in line with the body of the disc D to be rotated. This condition may be obtained by suitably displacing the slide 34 along the guides 30 and by acting on another optional adjustment device whereby the motor-reducer 36 is secured on a small slide 37 which is guided vertically as indicated at 38 on said slide 34. The slide 37 is anchored to a screw 39 which is rotatably mounted with no possibility of axial displacement in a projection 40 secured to the slide 34 (FIG. 4). By acting on the screw 39, the additional adjustment is obtained for axially aligning the motor-reducer 36 with said disc D.

The slides 34 and 37 are provided with through slots and holes 41-42 whereby the hollow shaft of the unit 36 may have keyed thereto, by means of a key 43, a shaft 44 provided with a longitudinal keyway 45 cooperating with said key and equipped, at the end directed towards the disc D, with a pointed tip 46 for centering in the blind hole usually formed in the body of said disc D, and is also equipped with a driving dog 47 which can engage one of the studs K usually securing the road-wheel to the body of the disc D and can drive said disc into rotation. A cylindrical coil spring 48 acting with an end thereof against the hollow shaft of the unit 36 and with the opposite end against a ring member 49, urges the shaft 44 towards the disc D, thus ensuring the necessary co-operation of the members 46-47 therewith. Preferably, the disc D is rotated in the direction indicated by F' in FIG. 2, that is the same as that which would be imparted to the disc D by the action of the grinding wheels 15–15′ so as to minimize the power and size of the drive unit 36.

In order to help in installing the machine, said shaft 44 may be retracted to keep the members 46-47 temporarily spaced from the disc D. For this purpose, the portion of the shaft 44 protruding rearwardly from the drive unit 36 has slidably mounted thereon a ring member 50 which may be locked by a radial screw 51 at any location of said shaft 44 so as to keep said shaft in the desired position retracted from the unit 36.

In order to avoid damaging the drive system described above, in case the gearbox connected to the disc D, is not in its neutral position, the following provisions have been devised. The pointed tip 46 and driving dog 47 are mounted on the extremity 152 of a rod 52 rotatably and axially arranged through the hollow shaft 44 and mounting at its rear end a set of cup-shaped Belleville springs 53 which are urged appropriately against the rear end of said shaft 44 by a unit 54 comprising a nut lock-nut. The numerals 55 and 56–56′ indicate washers of suitable material arranged at the ends of said shaft 44 between the members 54-53.

When the machine is to be positioned at the right-hand side or at the left-hand side of a vehicle, the slide 34 and associated parts shall be mounted on the guides 30 or on the guides 30′, respectively.

It is to be understood that various changes and modifications, especially of constructional nature, may be made to the machine described above. For example, instead of the frame 1 as described above, any other structure may be used having, for example, the advantage to be utilized with various types of motor-vehicles. The frame 1, or equivalent structure, may be provided with reference marks permitting to check the positioning of said structure with respect to the faces of the disc D. The movements of the grinding equipment may be controlled through pivotable links instead of the described guide slide systems. It is also contemplated that by using an electrical motor of suitable characteristics, the grinding wheels 15–15′ may be keyed directly on the shaft motor. Instead of the electrical motor 19, any other motor, such as pneumatic motor, may be used. The unit for driving the shaft 13 may not be connected to the slide 8 and may be coupled to said shaft 13 through a suitably-sheathed flexible shaft. A similar consideration may be made for the driving unit 36. It is also contemplated that the shaft 44 may be driven otherwise by a sheathed flexible shaft the opposite end of which is connected to a small reduction gear coupled to the main motor 19. Instead of two grinding wheels 15–15′ having the same characteristics, the machine may be provided with only one grinding wheel that should be pre-arranged to be rapidly inverted and keyed on the shaft 13 to permit both faces of a disc D to be ground. The grinding wheels 15–15′ may be of any type, either with full surface or with sector surface, and they may be cup-shaped or presenting any other shape suitable for the desired purpose.

We claim:

1. A machine for grinding a brake disc of a motor vehicle while the brake disc is mounted in a normal operating position on an axle journal of the vehicle, the vehicle including connections to which a hydraulic caliper cooperating with the brake disc is normally secured, the machine comprising:

a frame which is precisely secured to the connections after removal of the caliper whereby a portion of said frame has a pre-established and exact positioning with respect to the brake disc, said frame leaving a rear face portion and a front fact portion of the brake disc uncovered;

a working unit mounted on said portion of said frame, said working unit including (a) a tool shaft, (b) a grinding tool mounted on said tool shaft and having an abrading face parallel to the face portions of the brake disc, (c) an axial displacement means for displacing said tool shaft axially to bring said abrading surface into engagement with one of the front face portion and rear face portion, (d) a first drive means for rotating said tool shaft and hence said abrading face of said grinding tool, and for producing a rotating force on the brake disc when said abrading face contacts the one of the front face portion and rear face portion, and (e) a second drive means for driving the brake disc in rotation in the same direction as the rotating force produced by said first drive means, said second driving means including a drive shaft with a driving dog attached adjacent an end thereof, a small motor means for rotating said driving dog about an axis of said drive shaft, and an adjustment means for adjusting the position of said end to be adjacent a center of the brake disc and with said driving dog engaging a wheel stud of brake disc.

2. A machine for grinding as claimed in claim 1 wherein the brake disc includes a center blind hole, and wherein said drive shaft includes a pointed tip at the end adjacent the driving dog, whereby said adjustment means adjust said end of said drive shaft such that said pointed tip engages the blind hole.

3. A machine for grinding as claimed in claim 1 wherein said second drive means further includes an adjustable friction means between said driving dog and said driving shaft for allowing rotation of said drive shaft without rotation of said driving dog in order to avoid damage to said small motor means when the brake disc is locked in place and said second drive means is actuated.

4. A machine for grinding a brake disc of a motor vehicle while the brake disc is mounted in a normal operating position on an axle journal of the vehicle, the vehicle including connections to which a hydraulic caliper cooperating with the brake disc is normally secured, the machine comprising:

a frame which is precisely secured to the connections after removal of the caliper whereby a portion of said frame has a pre-established and exact positioning with respect to the brake disc, said frame leaving a rear face portion and a front face portion of the disc uncovered;

a working unit mounted on said portion of said frame, said working unit including (a) a tool shaft, (b) a pair of cup-shaped grinding wheels with each said grinding wheel having an abrading surface, said grinding wheels being mounted on said tool shaft with said abrading surfaces parallel to each other and to the face portions of the brake disc, facing each other, and spaced apart by a distance greater than a maximum thickness of the brake disc, (c) an axial displacement means for successively displacing said tool shaft first in one axial direction and then in a reverse axial direction whereby first one said abarding surface of one of said grinding wheels engages one of the front face portion and the rear face portion and then the other said abrading surface of the other said grinding wheel engages the other of the front face portion and the rear face portion, (d) a drive means for rotating said tool shaft and hence said abrading faces of said grinding wheels, and for producing a rotating force on the brake disc when one of said abrading surfaces contacts one of the face portions.

* * * * *